US008719998B1

(12) United States Patent
Huffman

(10) Patent No.: US 8,719,998 B1
(45) Date of Patent: May 13, 2014

(54) EXTRACTOR WITH LIGHT-SENSITIVE STAIN SENSOR

(75) Inventor: Eric C. Huffman, Lowell, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 13/106,544

(22) Filed: May 12, 2011

Related U.S. Application Data

(60) Provisional application No. 61/333,875, filed on May 12, 2010.

(51) Int. Cl.
*A47L 7/00* (2006.01)
*A47L 11/30* (2006.01)

(52) U.S. Cl.
USPC ..... 15/319; 15/320

(58) Field of Classification Search
USPC ..... 15/320, 319, 339
IPC ..... A47I 7/00,11/00, 11/30
See application file for complete search history.

(56) References Cited

U.S. PATENT DOCUMENTS 3,935,463 A * 1/1976 Jacobsen ..... 250/373
5,477,321 A * 12/1995 Johnson ..... 356/319
5,613,261 A * 3/1997 Kawakami et al. ..... 15/98
6,131,237 A 10/2000 Kasper et al.
6,339,472 B1 * 1/2002 Hafeman et al. ..... 356/433
6,446,302 B1 * 9/2002 Kasper et al. ..... 15/319
7,073,226 B1 7/2006 Lenkiewicz et al.
7,320,149 B1 * 1/2008 Huffman et al. ..... 15/320
8,214,968 B2 * 7/2012 Griffith et al. ..... 15/415.1
2006/0179599 A1 * 8/2006 Miner et al. ..... 15/320
2006/0272120 A1 12/2006 Barrick et al.
2009/0183335 A1 * 7/2009 Griffith et al. ..... 15/322

* cited by examiner

*Primary Examiner* — David Redding
(74) *Attorney, Agent, or Firm* — McGarry Bair PC

(57) ABSTRACT

A light-sensitive stain sensing system for an extractor for detecting and treating biological stains, such as food or pet stains. The stain sensing system comprises an ultraviolet light-emitting element, a visible light-emitting element, and at least one light reader. Ultraviolet and visible light beams are reflected off the surface to be cleaned into a light reader that measures reflectance values and transmits the values to a processor. The processor compares a relative reflectance value to a predetermined threshold value. The presence of a biological stain is indicated when the relative reflectance value is greater than the threshold value, and may trigger a controller to automatically adjust one or more cleaning parameters of the extractor.

17 Claims, 5 Drawing Sheets

EXTRACTOR WITH LIGHT-SENSITIVE STAIN SENSOR

CROSS-REFERENCE TO RELATED APPLICATION

This application claims the benefit of U.S. Provisional Patent Application No. 61/333,875, filed May 12, 2010, which is incorporated herein by reference in its entirety.

BACKGROUND OF THE INVENTION

Extraction cleaning machines are known for deep cleaning carpets and other fabric surfaces such as upholstery. Most carpet extractors comprise a fluid delivery system, a fluid recovery system, and, optionally, an agitation system. The fluid delivery system typically comprises one or more fluid supply tanks for storing cleaning fluid, a fluid distributor for applying the cleaning fluid to the surface to be cleaned, and a fluid supply conduit for supplying the fluid from the supply tank to the fluid distributor. The fluid recovery system typically comprises a recovery tank, a suction nozzle adjacent to the surface to be cleaned and in fluid communication with the recovery tank through a working air conduit, and a vacuum source in fluid communication with the working air conduit to draw cleaning fluid from the surface to be cleaned through the nozzle and working air conduit into the recovery tank. The agitation system can include an agitator element for scrubbing the surface to be cleaned, an optional drive means, and selective control means. The agitation system can include a fixed or driven agitator element that can comprise a brush, pad, sponge, cloth, and the like. The agitation system can also include driving and control means including motors, turbines, belts, gears, switches, sensors, and the like. See, for example, U.S. Pat. No. 6,131,237 to Kasper et al. and U.S. Pat. No. 7,073,226 to Lenkiewicz et al.

Vacuum cleaners and extractors may further include light emitting elements for illuminating spots and stains, sanitizing surfaces, and for enhancing cleaning performance. U.S. Patent Application Publication No. US 2006/0272120 published on Dec. 7, 2006 discloses a portable extraction cleaning device comprising a fluid delivery system, a fluid recovery system and ultraviolet light source positioned in or near the fluid supply tank, recovery tank, and suction nozzle to kill bacteria in the fluid used and recovered by the device as well as the surface to be cleaned. Also see, for example, U.S. patent application Ser. No. 12/473,847 to Tran et al. and titled "Unattended Spot Cleaning with Surface Sanitization."

BRIEF DESCRIPTION OF THE INVENTION

A surface cleaning apparatus, such as an extractor or a vacuum, according to one embodiment of the invention comprises a base and a stain sensing system. The stain sensing system can be mounted to the base and comprises an ultraviolet (UV) light-emitting element and a visible light-emitting element positioned so as to illuminate the surface to be cleaned. The stain sensing system further comprises at least one light reader for detecting light intensity as emitted by the visible and ultraviolet light-emitting elements as reflected from the surface to be cleaned.

The surface cleaning apparatus further comprises a controller which receives a first signal representative of the light reflected from the surface to be cleaned by the visible light-emitting element and a second signal representative of the light reflected from the surface to be cleaned by the UV light-emitting element. The controller determines a differential between the first signal and the second signal and compares the differential value to a predetermined threshold value. If the differential value exceeds the predetermined threshold value, the controller determines that a stain exists on the surface to be cleaned and may initiate an additional cleaning function.

In one embodiment, the stain sensing system is mounted in a housing and the visible light-emitting element, the UV light-emitting element, and the light reader are mounted therein. The controller actuates the visible and UV light-emitting elements in rapid succession and receives and stores the signals representative of the light received by the light reader over time.

In another embodiment, the stain sensing system is mounted in a housing having a partition positioned between the visible and UV light-emitting elements. Two light readers are mounted in the housing, a first light reader for receiving visible light and positioned in alignment with the visible light-emitting element, and a second light reader for receiving UV light and positioned in alignment with the UV light-emitting element.

DESCRIPTION OF EMBODIMENTS OF THE INVENTION

The present invention relates generally to extraction cleaning machines. In one of its aspects, the invention relates to an extractor with automatic stain sensing. In another of its aspects, the invention relates to a sensor module for an extractor utilizing ultraviolet light and visible light. For purposes of description related to the figures, the terms "upper," "lower," "right," "left," "rear," "front," "vertical," "horizontal," and derivatives thereof shall relate to the invention as oriented in FIG. 1 from the perspective of a user behind the extractor, which defines the rear of the extractor. However, it is to be understood that the embodiments of the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
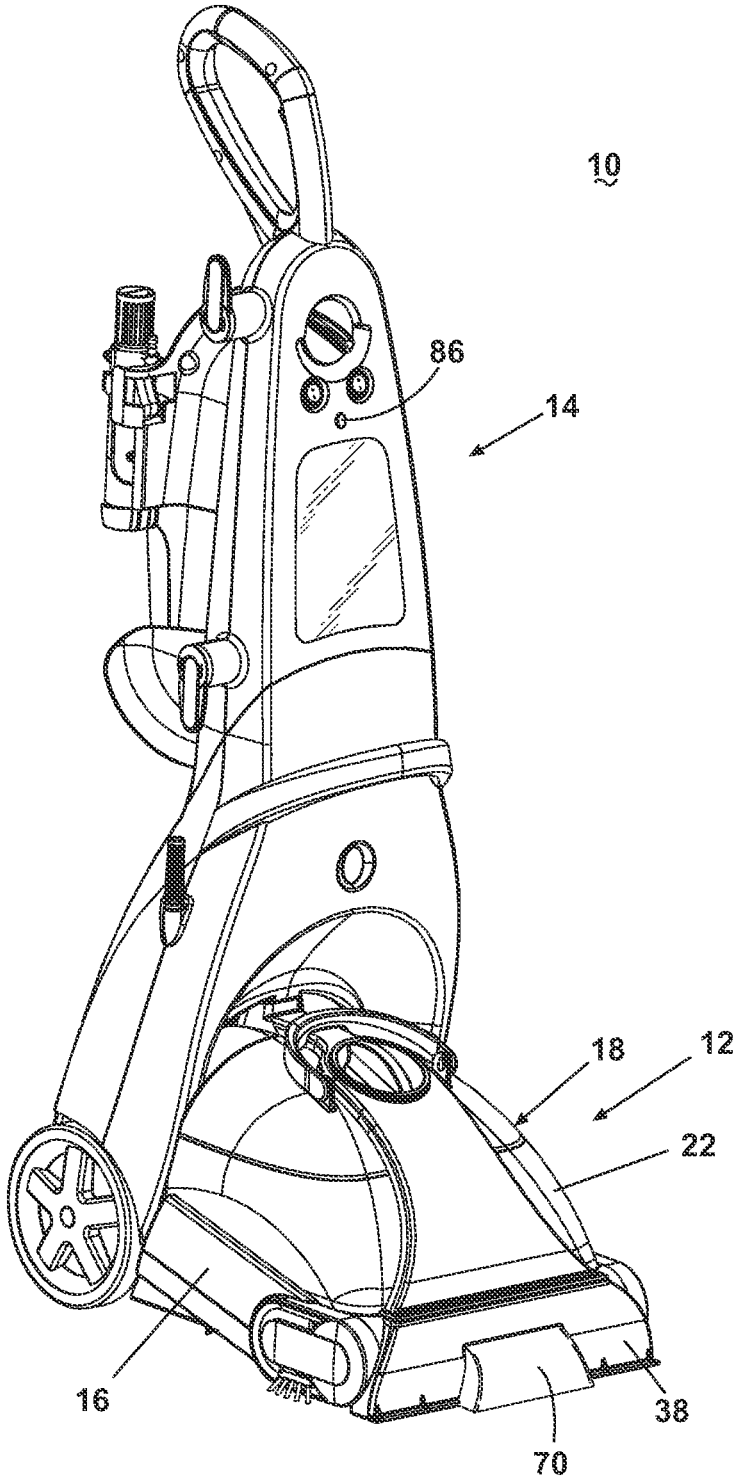
FIG. 1 is a perspective view of an upright extractor including a foot assembly having a sensor module according to a first embodiment of the invention.

FIG. 1 is a perspective view of an upright extractor 10 having a sensor module 70 according to a first embodiment of the invention. As illustrated, the extractor 10 comprises a housing having a foot assembly 12 for movement across a surface to be cleaned and an upright assembly 14 pivotally mounted to a rearward portion of the foot assembly 12 for directing the foot assembly 12 across the surface to be cleaned. The extractor 10 includes a fluid delivery system for storing cleaning fluid and delivering the cleaning fluid to the surface to be cleaned and a fluid recovery system for removing the spent cleaning fluid and dirt from the surface to be cleaned and storing the spent cleaning fluid and dirt, as shown in part in FIGS. 2 and 3. The components of the fluid delivery system and the fluid recovery system are supported by at least one of the base assembly 12 and the upright assembly 14. The extractor 10 is further provided with other known components which are not germane to the invention and therefore will not be described in detail herein. Details of a suitable extractor and an unattended extraction cleaning machine, as well as a description of other common extractor components, are disclosed in commonly assigned U.S. Pat. No. 6,131,237 to Kasper et al., U.S. Patent Application Publication No. 2006/0288518 to Lenkiewicz et al, U.S. Pat. No. 7,073,226 to Lenkiewicz et al., U.S. Pat. No. 7,320,149 to Huffman et al., and U.S. Pat. No. 7,228,589 to Miner et al., which are incorporated herein by reference in their entirety.

Figure 2:
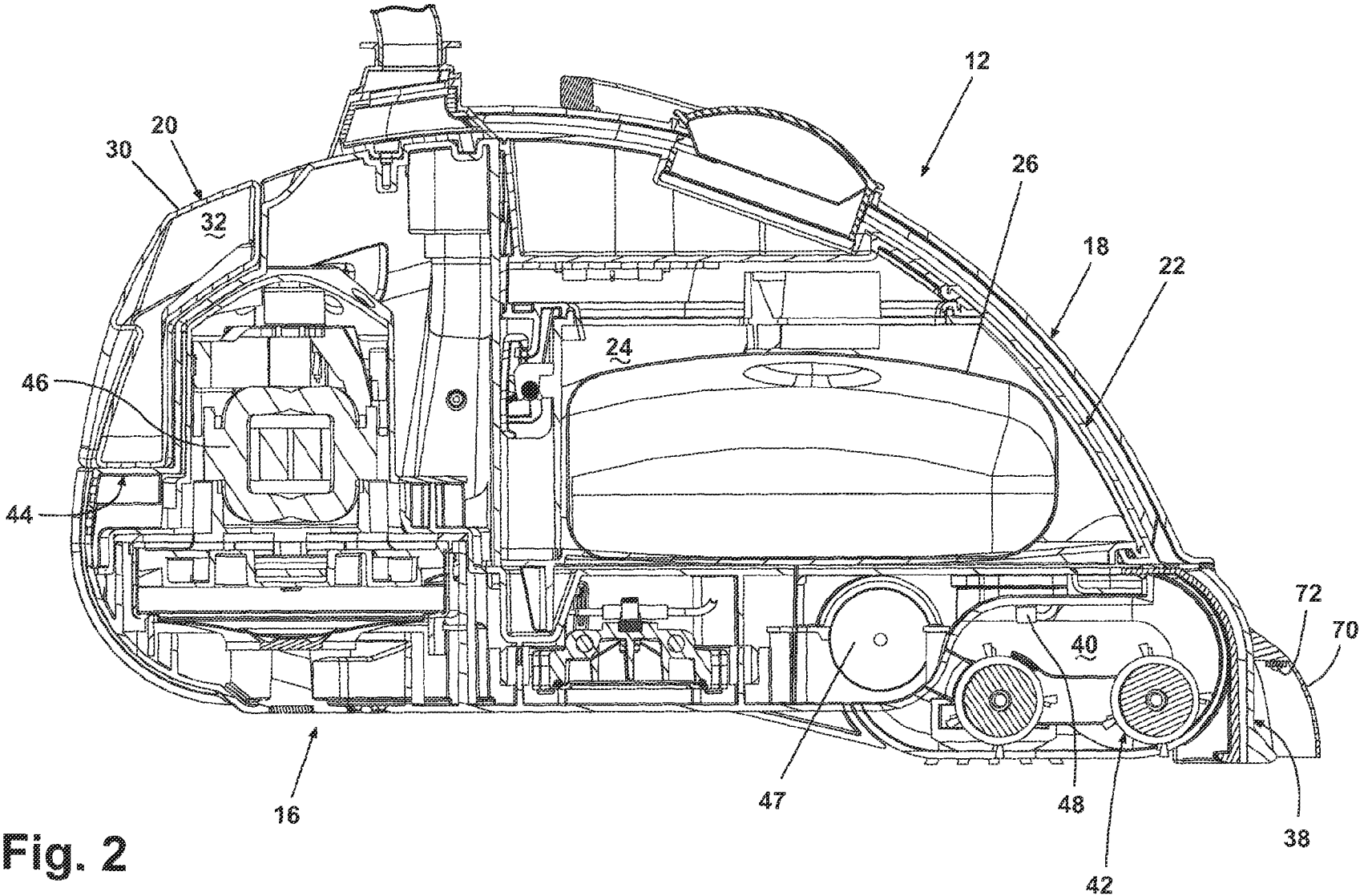
FIG. 2 is a cross-sectional view of the foot assembly of the extractor of FIG. 1, taken along the centerline of the extractor.

Referring additionally to FIG. 2, the foot assembly 12 comprises a base assembly 16 that supports a recovery tank assembly 18, which forms part of the fluid delivery and recovery systems, at a forward portion thereof, and a solution supply tank assembly 20, which forms part of the fluid delivery system, at a rearward portion thereof. The recovery tank assembly 18 comprises a recovery tank housing 22 that defines a recovery chamber 24 used to stored spent cleaning fluid and dirt that is recovered from the surface to be cleaned. The recovery tank housing 22 is sized to receive a flexible bladder 26 that is utilized as a cleaning fluid supply tank and stores a first cleaning fluid. A suitable bladder is disclosed in the above referenced Kasper '237 patent. The solution supply tank assembly 20 comprises a solution supply tank housing 30 that defines a solution supply chamber 32 and stores a second cleaning fluid. The first and second cleaning fluids can comprise any suitable cleaning fluid, including, but not limited to, water, concentrated detergent, diluted detergent, and the like. For example, the first cleaning fluid can be water, and the second cleaning fluid can be a concentrated detergent. Although not illustrated, other supply tanks or containers can be provided such that the fluid delivery system delivers cleaning fluid from separate tanks or containers that contain the same or different concentrations or compositions of cleaning fluid.

As best seen in FIG. 2, the base assembly 16 further comprises a nozzle assembly 38 removably mounted to a forward portion thereof The nozzle assembly 38 is in fluid communication with the recovery chamber 24, when the recovery tank assembly 18 is mounted to the base assembly 16, such that spent cleaning fluid and debris ingested through the nozzle assembly 38 is collected in the recovery chamber 24. A downwardly facing agitator cavity 40 is provided to the rear of the nozzle assembly 38 and receives an agitator assembly 42. At a rearward portion, the base assembly 16 includes a motor and fan assembly housing 44 for supporting a vacuum source illustrated as a vertically-oriented motor and fan assembly 46. The motor and fan assembly 46 is in fluid communication with the recovery chamber 24 when the recovery tank assembly 18 is mounted to the base assembly 16 such that air is drawn through the motor and fan assembly 46 before being exhausted from the extractor 10. A separate agitator motor 47 can be provided for driving the agitator assembly 42.

Figure 3:
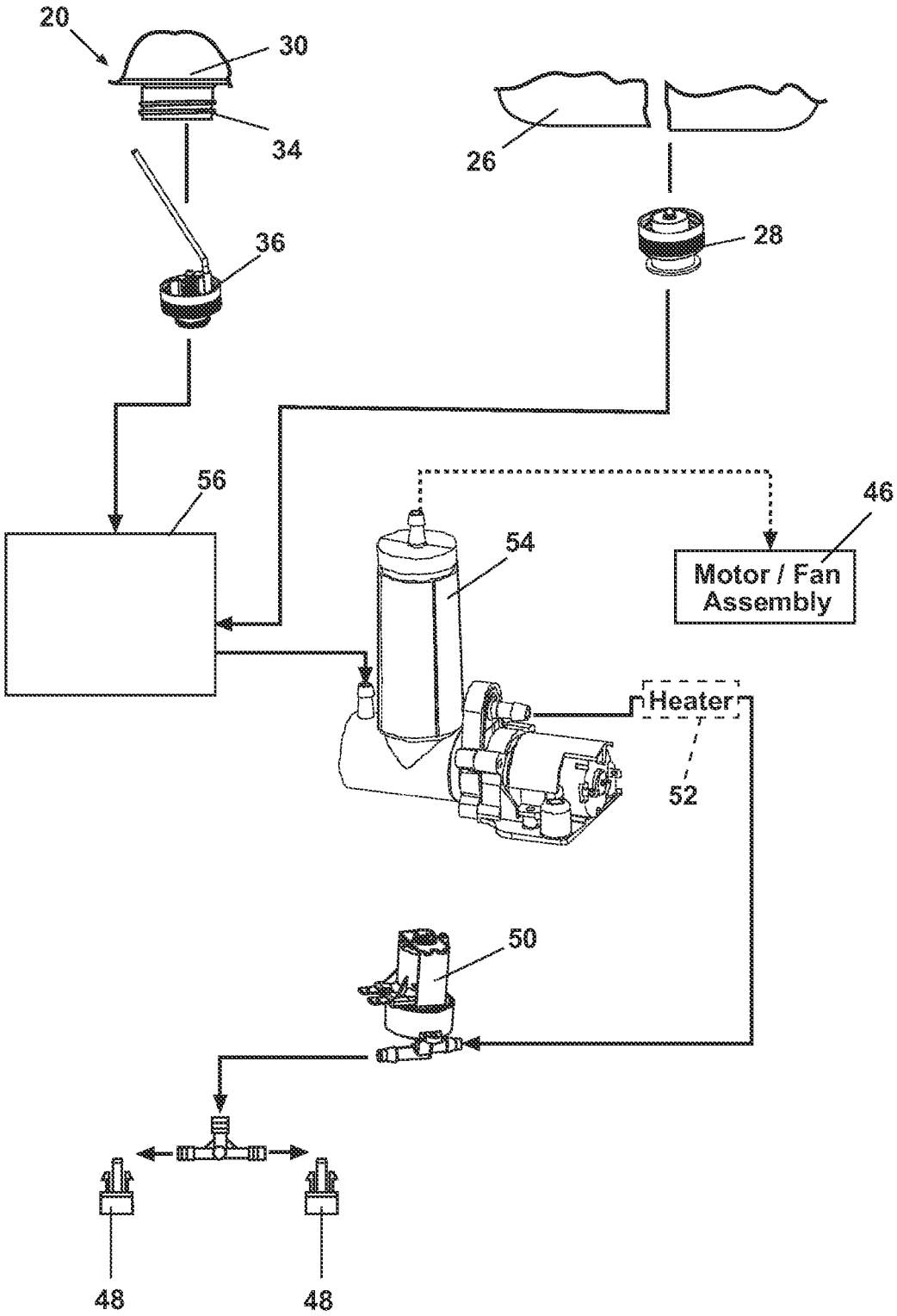
FIG. 3 is a partial schematic diagram of a fluid flow pathway for a fluid delivery system for the extractor of FIG. 1.

Referring to FIG. 3, the fluid delivery system includes the bladder 26, which comprises an outlet (not shown) that is secured to a valve mechanism 28 for controlling flow of the first cleaning fluid from the bladder 26. The solution supply tank housing 20 has an outlet 34 in a bottom wall thereof that receives a valve mechanism 36 for controlling flow of the second cleaning fluid from the solution supply chamber 32. The first cleaning fluid flows from the bladder 26 to a mixing/metering assembly 56. There, the first cleaning fluid optionally mixes with the second cleaning fluid from the solution supply tank housing 20. The fluid delivery system further comprises a pair of spray tips 48 located on the base assembly 16 for distributing cleaning fluid onto the surface to be cleaned. Details of the spray tips 48 are given in the Lenkiewicz application, referenced above. The spray tips 48 are in fluid communication with the agitator cavity 40 so that the fluid can be supplied from the spray tips 48 to the surface to be cleaned. The fluid delivery system further includes a spray tip valve 50 having an outlet that is in fluid communication with the spray tips 48. The spray tip valve 50 can be a solenoid valve, but can alternatively be a mechanically-operated valve. The fluid delivery system also includes an optional heater 52 and a pump assembly 54. The heater 52 can be any suitable heater configured to heat fluids, such as an in-line heater. The pump assembly 54 has a first inlet in fluid communication with the mixing/metering assembly 56 and an outlet in fluid communication with an inlet of the spray tip valve 50. The pump assembly 54 is operatively connected to the motor/fan assembly 46 for operation of a primer stack portion thereof, as described in the aforementioned Kasper patent. Alternatively, the pump can comprise a conventional solenoid pump.

Figure 4:
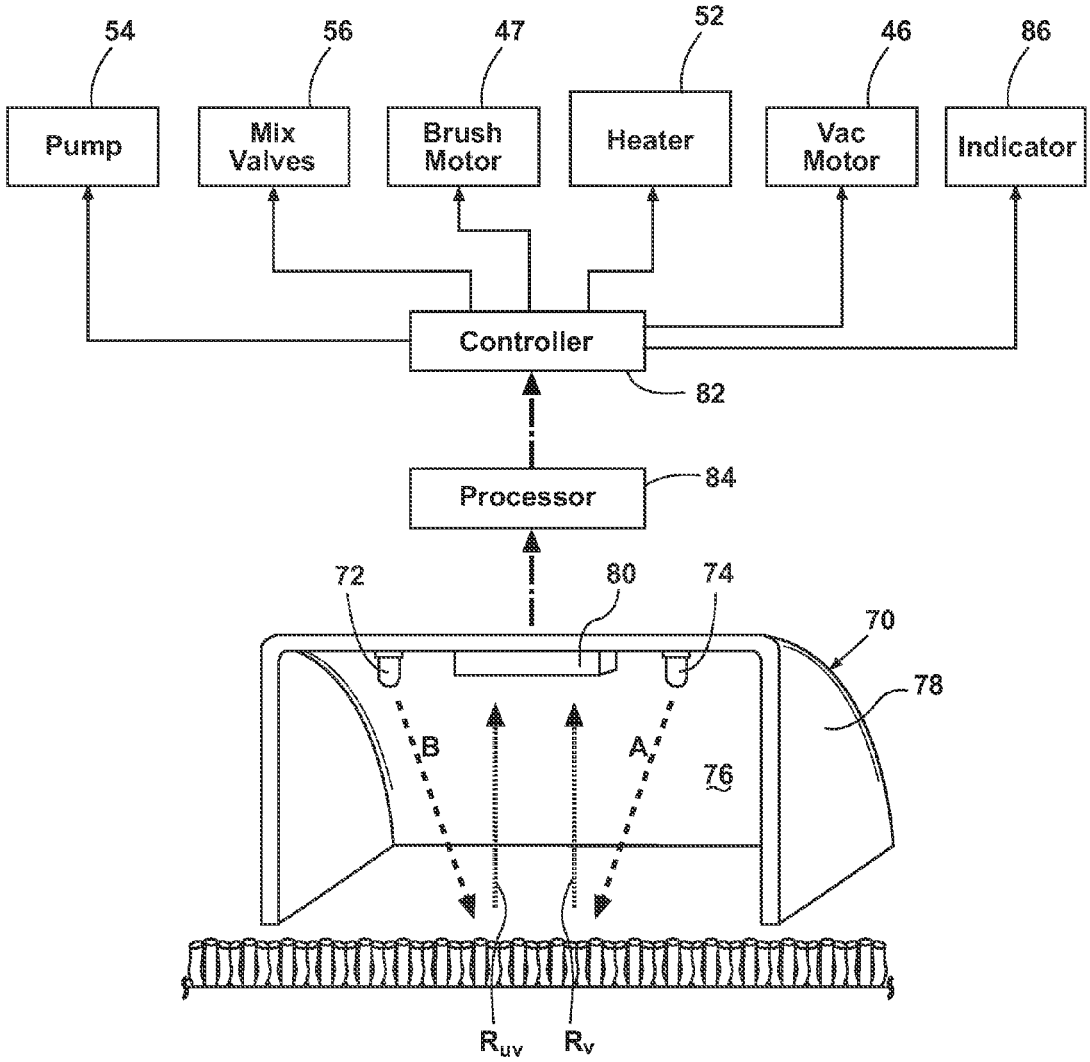
FIG. 4 is a schematic view of the sensor module, with a schematic diagram of an electrical control pathway for the extractor of FIG. 1.

Referring to FIGS. 1 and 4, in the illustrated embodiment, the sensor module 70 can be located on the base assembly 16. More specifically, the sensor module 70 can be located on the front of the base assembly 16, in front of the suction nozzle assembly 38. The sensor module 70 comprises a housing 78, a predominantly ultraviolet (UV) light-emitting element 72, a predominantly visible light-emitting element 74, and a light reader 80. The UV and visible light-emitting elements 72, 74 are mounted in an open bottom cavity 76 formed by the sensor module housing 78, which permits light from the light-emitting elements 72, 74 to shine on the surface to be cleaned. Further, the light reader 80 can also be located in the cavity 76. In the illustrated embodiment, the light reader 80 is mounted between the UV light-emitting element 72 and the visible light-emitting element 74; however, other orientations are possible. Alternatively, the sensor module 70 can be located elsewhere on the extractor 10, provided the light-emitting elements 72, 74 can shine on the surface to be cleaned and the light reader 80 can detect light reflected from the surface to be cleaned. For example, the sensor module 70 can be located on the bottom surface of the base assembly 16 within the footprint of the base assembly 16.

The UV light-emitting element 72 emits light at least partially within the ultraviolet region of the electromagnetic spectrum. The emitted light, however, can span both ultraviolet and visible ranges of the electromagnetic spectrum. The wavelength range of the ultraviolet portion of the light can range from approximately 10 nm~400 nm. The UV light-emitting element 72 can comprise a conventional UV lamp. Alternately, the UV light-emitting element 72 can comprise one or more light-emitting diodes (LEDs).

The UV light-emitting element 72 can be selected from a range of optional light-emitting elements based on the desired effect and dictated by the wavelength properties associated with the light-emitting element. For example, the UV light-emitting element 72 can be selected to enhance stain removal performance or activate certain cleaning chemical compositions. In one embodiment, the UV light-emitting element 72 can be selected to detect carbon-based stains. Light in the Ultraviolet A (UVA) range of the electromagnetic spectrum comprising a wavelength from about 400 nanometers to about 320 nanometers (also known as "black light") is effective for illuminating carbon-based stains, including food stains and pet stains such as urine stains. UVA light causes carbon-based stains to fluoresce, thus rendering an otherwise invisible stain visible to the eye. Furthermore, illuminating certain peroxygen cleaning compounds with UVA light can improve cleaning efficacy and decrease the cleaning cycle time. Alternatively, the UV light-emitting element 72 can emit light in the Ultraviolet C (UVC) range of the electromagnetic spectrum, which can provide surface sanitization and disinfection properties. UVC light exposure has a germicidal effect and can eradicate odor-causing bacteria by destroying the DNA and RNA of microbes, thereby rendering them impotent and unable to multiply. Surface sanitization and disinfection is best achieved with a light source having a UVC wavelength of about 260 nanometers. However, a range of about 280 to about 200 nanometers is also acceptable.

The visible light-emitting element 74 emits light having a wavelength in the visible region of the electromagnetic spectrum ranging from approximately 380 nm~760 nm. The visible light-emitting element 74 can comprise at least one conventional lamp or LED.

The UV and visible light-emitting elements 72 and 74 are removably received within the cavity 76 such that the light-emitting elements 72 and 74 can be repaired and/or replaced as necessary. Each light-emitting element 72, 74 is electrically connected to power output terminals (not shown) on a controller 82 via conventional electrical wiring (not shown). The controller 82 selectively energizes the UV and visible light-emitting elements 72 and 74.

The light reader 80 comprises a conventional light reader, such as a photoresistor, that is capable of detecting light intensity, and is positioned to determine at least one reflectance value from the surface to be cleaned. The light reader 80 is operably connected to a processor 84, which receives the reflectance values measured by the light reader 80 and is operably connected to the controller 82. The processor 84 is located in one of the foot assembly 12 and the upright handle assembly 14.

The controller 82 is located in one of the foot assembly 12 and the upright handle assembly 14 and selectively regulates any combination of the motor/fan assembly 46, agitator motor 47, pump assembly 54, spray tip valve 50, optional heater 52, UV and visible light-emitting elements 72 and 74, and light reader 80. The controller 82 can initiate pre-programmed responses upon detection of a biological stain, the method of which is described hereinafter. Additionally, the controller can be operably connected to an indicator 86 provided on the exterior of the extractor 10 and configured to provide user feedback such as operational mode indicia or other pertinent status information. For example, indicator 86 can display alerts to indicate stain detection, cleaning cycle progress, and the like. Indicator 86 can include one or more visual or audible indicators, such as LEDs and signal tone generators.

The sensor module 70 is configured to detect and automatically treat biological stains, such as food or pet stains. In operation, the sensor module 70 repeatedly emits a predominantly visible light beam "A" from the visible light-emitting element 74 and a predominantly UV light beam "B" from the UV light-emitting element 72. Light beams "A" and "B" are preferably emitted in rapid succession and are reflected off the cleaning surface toward the light reader 80, which measures reflectance values $R_{UV}$ and $R_V$ and transmits them to the processor 84. $R_{UV}$ is the reflectance value measured from the UV light beam "B", and $R_V$ is the reference reflectance value measured from the visible light beam "A". Both reflectance values $R_{UV}$ and $R_V$ can fluctuate in response to color variations of the cleaning surface, including different base colors, patterns, or textures. For example, light-colored carpets, light stripes or other light patterns generally tend to generate higher $R_{UV}$ and $R_V$ reflectance values upon exposure to visible and ultraviolet light sources when compared to darker colored carpets or darker background colors in patterned carpets. UV light, however, causes biological stains to fluoresce whereas visible light generally does not, except for a small range of visible wavelengths that overlap the UV spectrum ranging from approximately 380 nm~400 nm. Thus, the presence of a biological stain will generally register a higher $R_{UV}$ value compared to the $R_{UV}$ value at the same location absent the biological stain. Similarly, $R_V$ may also increase in the presence of a biological stain due to the small overlapping wavelength range that coexist in both the visible and UV spectrums, but generally $R_V$ will not increase to the same extent as $R_{UV}$. Accordingly, by coupling a visible light beam "A" with an ultraviolet beam "B", and measuring reflectance values $R_{UV}$ and $R_V$ for both light sources, the sensor module 70 is adapted to compensate for color variations in the cleaning surface and configured to accurately distinguish biological stains from mere variations in carpet color, thereby avoiding erroneous stain detection.

Reflectance values $R_{UV}$ and $R_V$ are stored in memory as the extractor traverses the cleaning path. At any point in time, the processor can compare any of the previous reflectance values to the most recent values. During operation, the processor 84 compares the reflectance values $R_{UV}$ and $R_V$, over at least two points in time, and generates a delta UV-visible light reflectance value $R_\Delta$. The delta UV-visible light reflectance value $R_\Delta$ is then compared to a predetermined threshold value $R_T$, which is programmed into the processor 84. Upon encountering a biological stain the delta UV-visible light reflectance value $R_\Delta$ will exceed the threshold value $R_T$. The threshold value $R_T$ may be pre-programmed and may optionally be user-adjustable to accommodate cleaning surfaces having a wide variety of colors, patterns, and textures.

In normal operation, when the unit has not traversed onto a biological stain, the delta UV-visible light reflectance value $R_\Delta$ will remain consistent. Even if the unit traverses different colored cleaning surfaces or crosses a color variation such as a light colored stripe or pattern in the carpet, both reflectance values $R_{UV}$ and $R_V$ will increase (or decrease) relative to the prior reflectance measurements. Thus, although delta UV-visible light reflectance value $R_\Delta$ will likely increase when the unit traverses an unstained bright stripe, the resultant $R_\Delta$ will not exceed the threshold $R_T$ and will not trigger an erroneous stain detection. Accordingly, by comparing $R_\Delta$ during operation, the sensor module 70 essentially discards the visible component of $R_{UV}$, which permits the sensor module 70 to accurately distinguish biological stains from mere color variations of the cleaning surface.

However, because UV light causes a biological stain to fluoresce, the reflectance value $R_{UV}$ of the predominantly UV light will increase when the UV light-emitting element 72 is exposed to a biological stain on the surface to be cleaned beneath the sensor module 70.

When a biological stain is detected and delta UV-visible light reflectance value $R_\Delta$ exceeds the threshold value $R_T$, the processor 84 can signal the controller 82 to automatically initiate a pre-programmed response, which can include adjusting one or more cleaning parameters of the extractor 10. These parameters can include, but are not limited to, the cleaning fluid detergent mix ratio, the cleaning fluid flow rate, the application of a supplemental enzyme detergent, interrupting suction to increase detergent dwell time, varying the agitator speed or height, changing the temperature of the cleaning fluid, and increasing the force on the surface to be cleaned applied by the agitator. The controller 82 can adjust these parameters by regulating power to at least one of the motor/fan assembly 46, agitator motor 47, pump assembly 54, spray tip valve 50, and heater 52.

Alternately, upon detecting a biological stain, the controller 82 can simply alert the user, such as by energizing the indicator 86 instead of initiating a pre-programmed response that automatically adjusts cleaning parameters. The user can then determine how to treat the biological stain, such as by manually cleaning the stain, using the extractor 10, or using an accessory tool with the extractor 10.

Figure 5:
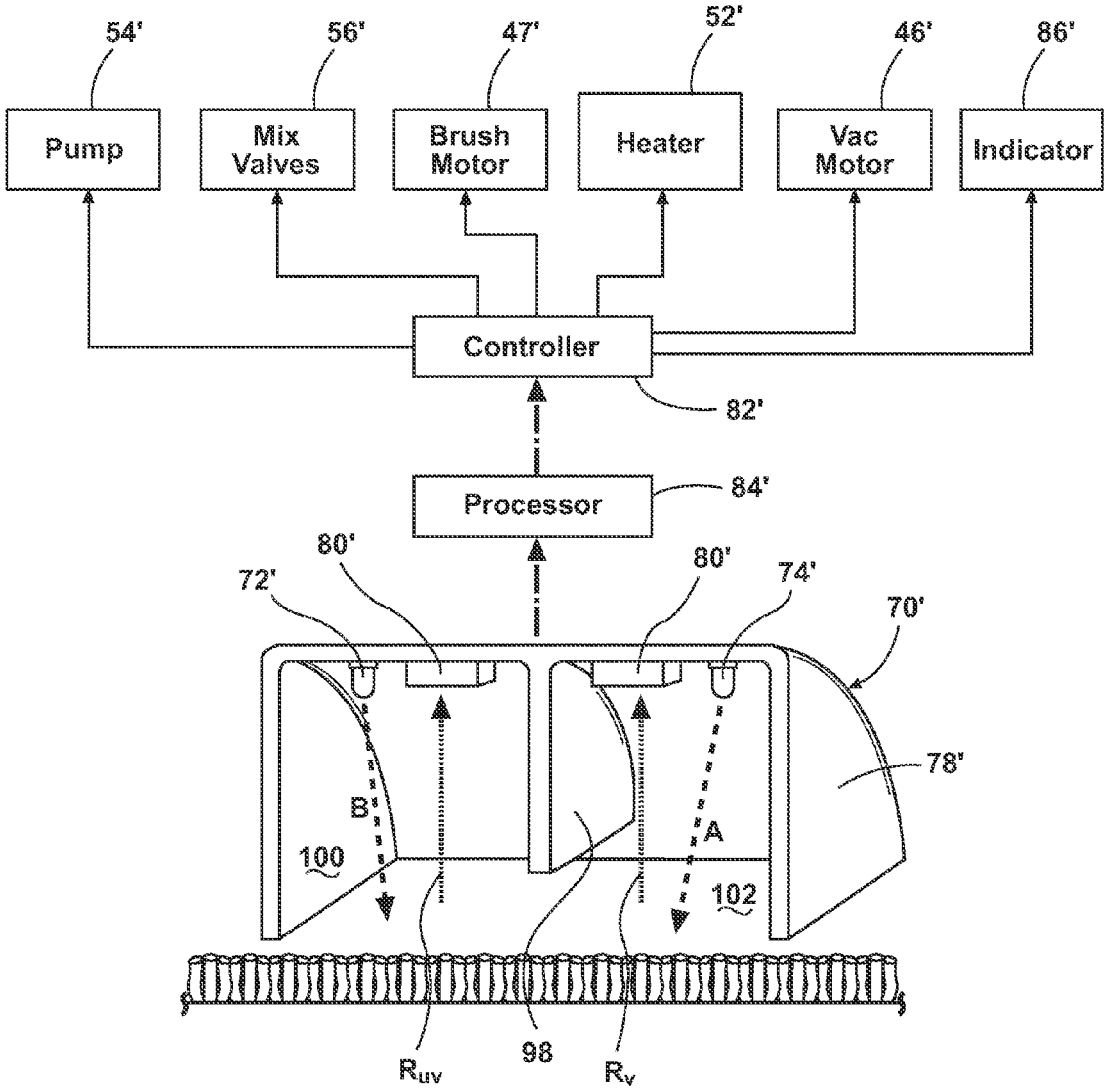
FIG. 5 is a perspective view of a sensor module according to a second embodiment of the invention, with a partial schematic diagram of an electrical control pathway for an extractor comprising the sensor module according to the second embodiment.

FIG. 5 illustrates a sensor module 70' according to a second embodiment of the invention, where like features are indicated with the same reference numerals bearing a prime symbol ('). The second embodiment of sensor module 70' can substitute the first embodiment of the sensor module 70 employed in the extractor of FIG. 1. In the second embodiment, the sensor module housing 78' includes a partition 98, which divides the otherwise single open bottom cavity into two cavities comprising a first UV light cavity 100 and a second visible light cavity 102. The sensor module 70' further comprises two light readers 80'. The UV light-emitting element 72' and the first light reader 80' are mounted in the UV light cavity 100 and isolated from the visible light-emitting element 74' and the second light reader 80' mounted within the visible light cavity 102. The partition 98 separates cavities 100, 102 and permits the UV light-emitting element 72 and first light reader 80' to operate concurrently instead of consecutively with the visible light-emitting element 74' and second light reader 80'.

In operation, the sensor module 70' can simultaneously emit a visible light beam "A" from the visible light-emitting element 74' and a UV light beam "B" from the UV light-emitting element 72'. The emitted light beams "A" and "B" are reflected off the surface to be cleaned; the UV light beam is reflected off the surface to be cleaned toward the light reader 80' within the UV light cavity 100, and the visible light beam is reflected off the surface to be cleaned toward the light reader 80' within the visible light cavity 102. As defined above in the first embodiment, $R_{UV}$ is the reflectance value measured from the UV light beam "B", and $R_V$ is the reference reflectance value measured from the visible light beam "A". Each light reader 80' transmits the corresponding reflectance value $R_{UV}$, $R_V$ to the processor 84'. Similar to the first embodiment, during operation, the processor 84' compares the reflectance values $R_{UV}$ and $R_V$, over at least two points in time, and generates a delta UV-visible light reflectance value $R_\Delta$. The delta UV-visible light reflectance value $R_\Delta$ is then compared to a predetermined threshold value $R_T$, which is programmed into the processor 84. Upon encountering a biological stain the delta UV-visible light reflectance value $R_\Delta$ will exceed the threshold value $R_T$. The threshold value $R_T$ may be pre-programmed and may optionally be user-adjustable to accommodate cleaning surfaces having a wide variety of colors, patterns, and textures. When a biological stain is detected and the delta UV-visible light reflectance value $R_\Delta$ exceeds the threshold value $R_T$, the processor 84' can signal the controller 82' to automatically initiate a pre-programmed response, which can include adjusting one or more cleaning parameters of the extractor 10. These parameters can include, but are not limited to, the cleaning fluid detergent mix ratio, the cleaning fluid flow rate, the application of a supplemental enzyme detergent, interrupting suction to increase detergent dwell time, varying the agitator speed or height, changing the temperature of the cleaning fluid, and increasing the force on the surface to be cleaned applied by the agitator. The controller 82' can adjust these parameters by regulating power to at least one of the motor/fan assembly 46', agitator motor 47', pump assembly 54', spray tip valve 50', and heater 52'.

Alternately, upon detecting a biological stain, the controller 82' can simply alert the user, such as by energizing the indicator 86 (FIG. 1) instead of initiating a pre-programmed response that automatically adjusts cleaning parameters. The user can then determine how to treat the biological stain, such as by manually cleaning the stain, using the extractor 10, or using an accessory tool with the extractor 10.

While the invention has been specifically described in connection with certain specific embodiments thereof, it is to be understood that this is by way of illustration and not of limitation, and the scope of the appended claims should be construed as broadly as the prior art will permit. The illustrated extractor is but one example of the variety of extractors with which this invention or some slight variant can be used. While shown and described for use with an upright extractor, the sensor module 70 can be used with any type of extractor, such as an unattended or robotic extraction cleaning machine, as disclosed in the above referenced Miner '589 and Huffman '149 patents. Reasonable variation and modification are possible within the forgoing disclosure and drawings without departing from the scope of the invention which is defined by the appended claims. It should also be noted that all elements of all of the claims may be combined with each other in any possible combination, even if the combinations have not been expressly claimed.

What is claimed is:

1. A surface cleaning apparatus comprising:

a housing for movement along a surface to be cleaned;

a suction nozzle associated with the housing and having a nozzle opening directed at the surface to be cleaned;

a vacuum source associated with the housing and in fluid communication with the suction nozzle via a working air conduit;

a recovery chamber in fluid communication with the vacuum source and the working air conduit whereby material drawn into the suction nozzle by the vacuum source is deposited into the recovery chamber;

a stain sensing system directed at the surface to be cleaned and comprising:

a visible light-emitting element;

an ultraviolet (UV) light-emitting element; and at least one light reader for detecting light intensity as reflected from the surface to be cleaned when light is emitted from the at least one of the visible and UV light-emitting elements; and a controller for receiving a signal representative of the light received by the at least one light reader;

wherein the controller receives a first signal representative of the light reflected from the surface to be cleaned by the visible light-emitting element and a second signal representative of the light reflected from the surface to be cleaned by the UV light-emitting element; and wherein the controller determines a differential value between the first signal and the second signal and compares the differential value to a predetermined threshold value.

2. The surface cleaning apparatus of claim 1 wherein the controller initiates an additional cleaning function when the differential value exceeds the predetermined threshold value.

3. The surface cleaning apparatus of claim 2 wherein the additional cleaning function can comprise changing at least one of: the speed of an agitator, a power amount supplied to the vacuum source, a parameter of a cleaning fluid applied to the surface to be cleaned, a rate at which a cleaning fluid is applied to the surface to be cleaned, the temperature of an applied cleaning fluid, supploying a cleaning solution to the surface to be cleaned, alerting a user of the surface cleaning device that a stain was detected, applying a supplemental cleaning fluid to the surface to be cleaned, interrupting suction supplied to the suction nozzle by the vacuum source, varying an agitator height, and increasing a force on the surface to be cleaned applied by an agitator.

4. The surface cleaning apparatus of claim 1 wherein the stain sensing system is mounted to the housing adjacent the suction nozzle.

5. The surface cleaning apparatus of claim 1 wherein the stain sensing system further comprises a housing which mounts the visible light-emitting element, the UV light-emitting element, and the light reader.

6. The surface cleaning apparatus of claim 5 wherein the housing for the stain sensing system is mounted to the housing for movement along the surface to be cleaned in a configuration which directs the visible light-emitting element and the UV light-emitting element toward the surface to be cleaned.

7. The surface cleaning apparatus of claim 5 wherein the at least one light reader comprises a first light reader adapted to receive visible light, and a second light reader adapted to receive UV light.

8. The surface cleaning apparatus of claim 1 and further comprising a partition positioned between the visible light-emitting element and the UV light-emitting element, wherein the at least one light reader comprises:

a first light reader adapted to receive visible light and positioned in alignment with the visible light-emitting element; and a second light reader adapted to receive UV light and positioned in alignment with the UV light-emitting element.

9. The surface cleaning apparatus of claim 1 and further comprising a liquid dispensing system including:

a cleaning fluid supply tank;

at least one cleaning fluid dispenser having an outlet opening for distributing cleaning fluid onto the surface to be cleaned;

a supply conduit interconnecting the cleaning fluid supply tank and the cleaning fluid dispenser for supplying cleaning fluid to the fluid dispenser; and a pump in the supply conduit to pump the cleaning fluid from the cleaning fluid supply tank to the fluid dispenser.

10. The surface cleaning apparatus of claim 1 and further comprising an agitator aligned with the suction nozzle for working debris from the surface being cleaned.

11. A surface cleaning apparatus comprising:

a housing for movement along a surface to be cleaned;

a suction nozzle associated with the housing and having a nozzle opening directed at the surface to be cleaned;

a vacuum source associated with the housing and in fluid communication with the suction nozzle via a working air conduit;

a recovery chamber in fluid communication with the vacuum source and the working air conduit whereby material drawn into the suction nozzle by the vacuum source is deposited into the recovery chamber; and a stain sensing system directed at the surface to be cleaned and comprising:

a visible light-emitting element;

an ultraviolet (UV) light-emitting element; and at least one light reader for detecting light intensity as reflected from the surface to be cleaned when light is emitted from at least one of the visible and UV light-emitting elements;

wherein the stain sensing system determines that a stain condition exists on the surface to be cleaned by:

reflecting visible light from the visible light-emitting element off of the surface to be cleaned;

reflecting UV light from the UV light-emitting element off of the surface to be cleaned;

measuring a visible light value and a UV light value and determining a differential therebetween; and determining whether the differential exceeds a predetermined value.

12. The surface cleaning apparatus of claim 11 and further comprising a controller for receiving a signal representative of the light received by the at least one light reader.

13. The surface cleaning apparatus of claim 11 and further comprising:

a controller adapted to actuate the visible light-emitting element and the UV light-emitting element in rapid succession and to receive and store signals representative of the light received by the at least one light reader over time.

14. The surface cleaning apparatus of claim 11 wherein the stain sensing system is mounted to the housing adjacent the suction nozzle.

15. A surface cleaning apparatus comprising:

a housing for movement along a surface to be cleaned;

a suction nozzle associated with the housing and having a nozzle opening directed at the surface to be cleaned;

a vacuum source associated with the housing and in fluid communication with the suction nozzle via a working air conduit;

a recovery chamber in fluid communication with the vacuum source and the working air conduit whereby material drawn into the suction nozzle by the vacuum source is deposited into the recovery chamber; and a stain sensing system directed at the surface to be cleaned and comprising:

a visible light-emitting element;

an ultraviolet (UV) light emitting element; and at least one light reader for detecting light intensity as reflected from the surface to be cleaned when light is emitted from at least one of the visible and UV light-emitting elements;

wherein the stain sensing system includes a controller which:

measures a differential value over time between a first measured UV light reflectance value as received by the at least one light reader from light emitted by the UV light-emitting element and a second measured visible light reflectance value as received by the at least one light reader from light emited by the visible light-emitting element; and initiates a response when the differential value exceeds a predetermined reflectance value.

16. The surface cleaning apparatus of claim 15 wherein the response comprises changing at least one of: the speed of an agitator, a power amount supplied to the vacuum source, a parameter of a cleaning fluid applied to the surface to be cleaned, a rate at which a cleaning fluid is applied to a surface to be cleaned, the temperature of an applied cleaning fluid, supplying a cleaning solution to the surface to be cleaned, alerting a user of the surface cleaning device that a stain was detected, applying a supplemental cleaning fluid to the surface to be cleaned, interrupting suction supplied to the suction nozzle by the vacuum source, varying an agitator height, and increasing a force on the surface to be cleaned applied by an agitator.

17. The surface cleaning apparatus of claim 15 wherein the stain sensing system is mounted to the housing adjacent the suction nozzle.

* * * * *